US007216621B2

(12) United States Patent
Pigott et al.

(10) Patent No.: US 7,216,621 B2
(45) Date of Patent: May 15, 2007

(54) DOUBLE SHEAVE ACCESSORY DRIVE PULLEY

(75) Inventors: Jeffrey A. Pigott, Wyandotte, MI (US); David G. Kokochak, Brooklyn, MI (US)

(73) Assignee: General Motors Corporation, Detroit, MI (US)

( * ) Notice: Subject to any disclaimer, the term of this patent is extended or adjusted under 35 U.S.C. 154(b) by 75 days.

(21) Appl. No.: 10/854,359

(22) Filed: May 26, 2004

(65) Prior Publication Data

US 2005/0263127 A1 Dec. 1, 2005

(51) Int. Cl.
*F02B 27/06* (2006.01)

(52) U.S. Cl. ..... 123/195 A; 474/903

(58) Field of Classification Search ..... 123/198 R, 123/90.31; 474/903
See application file for complete search history.

(56) References Cited

U.S. PATENT DOCUMENTS 4,502,345 A * 3/1985 Butterfield ..... 74/336 B
5,216,989 A * 6/1993 Iwata et al. ..... 123/90.31
5,301,645 A * 4/1994 Ball et al. ..... 123/198 R
5,678,516 A * 10/1997 Sakurai ..... 123/198 R
5,797,306 A * 8/1998 Kufahl ..... 83/257
6,079,385 A * 6/2000 Wicke ..... 123/198 R
6,609,491 B2 * 8/2003 Itoh et al. ..... 123/195 A
6,631,702 B2 * 10/2003 Tonnqvist et al. ..... 123/198 R
6,904,887 B2 * 6/2005 Higashide et al. ..... 123/195 A

* cited by examiner

*Primary Examiner*—Noah P. Kamen
*Assistant Examiner*—Jason Benton
(74) *Attorney, Agent, or Firm*—Christopher DeVries

(57) ABSTRACT

The present invention provides a pulley assembly adapted to transmit torque from a drive pulley to first and second driven accessories. The pulley assembly generally includes a housing and an auxiliary drive component. The auxiliary drive component is rotatably supported by the housing and adapted to be coupled to the first driven accessory. The auxiliary drive component includes first and second annular drive surfaces. The first drive surface is adapted to be drivingly coupled to the drive pulley and the second drive surface is adapted to be drivingly coupled to the second driven accessory.

16 Claims, 3 Drawing Sheets

DOUBLE SHEAVE ACCESSORY DRIVE PULLEY

FIELD OF THE INVENTION

The present invention relates to an automotive accessory drive pulley and, more particularly, to a double drive pulley assembly adapted to drive a plurality of automotive vehicle accessories and support loads associated therewith.

BACKGROUND OF THE INVENTION

Automotive engine accessories such as generators, air conditioning compressors, and power steering pumps are typically driven by engine torque. The torque is transmitted through a serpentine belt wrapped around an engine crankshaft pulley and routed around a series of additional pulleys mounted on the front of the engine accessories. It is critical to position the accessories on the engine to ensure adequate belt wrap at the pulleys to provide maximum power transmission throughout all driving conditions. If the belt wrap is insufficient, the belt may slip under certain conditions. Belt slippage results in reduced accessory performance, reduced belt durability, and increased noise. Additionally, it is critical to ensure that the belt or belts are adequately taught to provide maximum power transmission and to minimize belt slippage. However, high belt tension results in high radial loads being transferred to the crankshaft and other pulleys. These radial loads are then transferred to the engine accessory drive shafts, which can ultimately reduce the useful life of the accessories.

Further design challenges relate to the desire of Original Equipment Manufacturers to increase the number of engine accessories, thereby increasing the complexity of these belt and pulley systems, while reducing the envelope available for the engine and the engine accessories. One attempt to overcome these challenges includes driving a plurality of belts directly from the crankshaft, thereby providing direct power to a plurality of accessories. Unfortunately, vehicle steering, suspension, or any other automotive system or systems may occupy the packaging space and preclude the use of a plurality of drive belts directly driven by the crankshaft.

SUMMARY OF THE INVENTION

The present invention provides a pulley assembly adapted to transmit torque from a drive pulley to first and second driven accessories. The pulley assembly generally includes a housing and an auxiliary drive component. The auxiliary drive component is rotatably supported by the housing and adapted to be coupled to the first driven accessory. The auxiliary drive component includes first and second annular drive surfaces. The first drive surface is adapted to be drivingly coupled to the drive pulley and the second drive surface is adapted to be drivingly coupled to the second driven accessory.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the scope of the invention, its application, or its uses.

Figure 1:
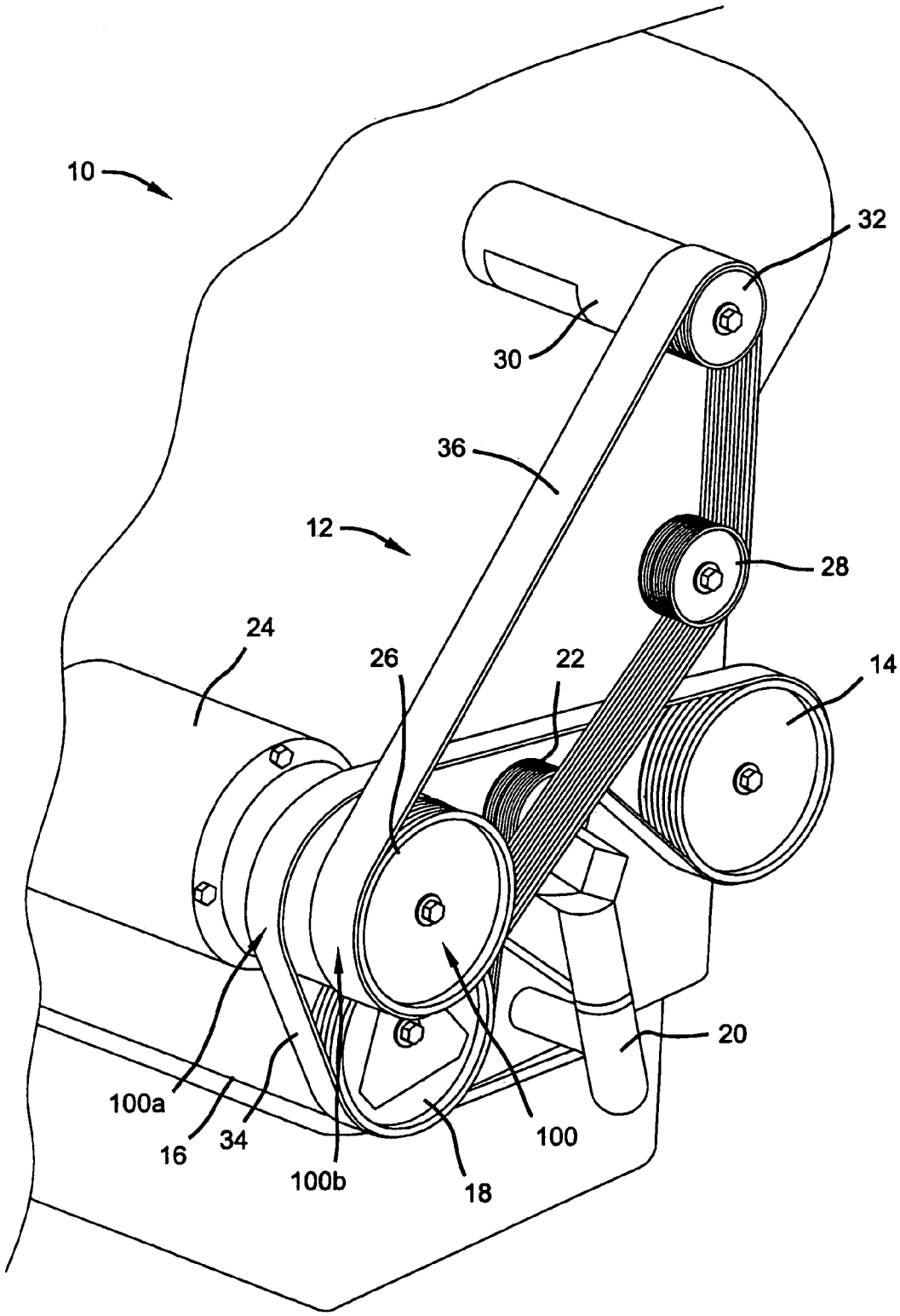
FIG. 1 is a perspective view of an exemplary pulley configuration including a double pulley assembly in accordance with the present invention.

Referring to FIG. 1, an exemplary pulley configuration for an automotive vehicle engine 10 is illustrated at reference numeral 12. The configuration generally includes a crankshaft pulley 14, an air conditioner compressor 16 having a compressor pulley 18, a linear tensioner 20 having a tensioner pulley 22, a power steering pump 24 having a pump pulley 26, an idler pulley 28, a supercharger 30 having a supercharger pulley 32, a serpentine belt 34, and an auxiliary belt 36. The pump pulley 26 illustrated in FIG. 1 includes a double sheave pulley assembly 100 in accordance with the present invention. The double sheave pulley assembly 100 includes a first pulley portion 100*a* and a second pulley portion 100*b*. The serpentine belt 34 wraps around the crankshaft pulley 14, the tensioner pulley 22, the compressor pulley 18, and the first pulley portion 100*a* of the pump pulley 26. The auxiliary belt 36 wraps around the second pulley portion 100*b* of the pump pulley 26, the idler pulley 28, and the supercharger pulley 32. While the pulley configuration and accessories described herein generally relate to automobiles, the double pulley assembly of the present invention may also be applied to other motorized devices such as boats, snowmobiles, tractors and the like.

During operation, the serpentine belt 34 transfers torque produced by an engine 10, via the crankshaft pulley 14, to the air conditioner compressor 16 and power steering pump 24. In addition, the auxiliary belt 36 transfers drive torque from the crankshaft pulley 14 to the supercharger 30, via the pump pulley 26. It should be appreciated that while the double sheave pulley assembly 100 is illustrated as being employed on the power steering pump 24, alternate locations are within the scope of the present invention. For example, the double pulley assembly may be coupled to a water pump, a generator, a hydraulic pump, an air conditioning compressor, a supercharger, or another accessory not listed.

Figure 2:
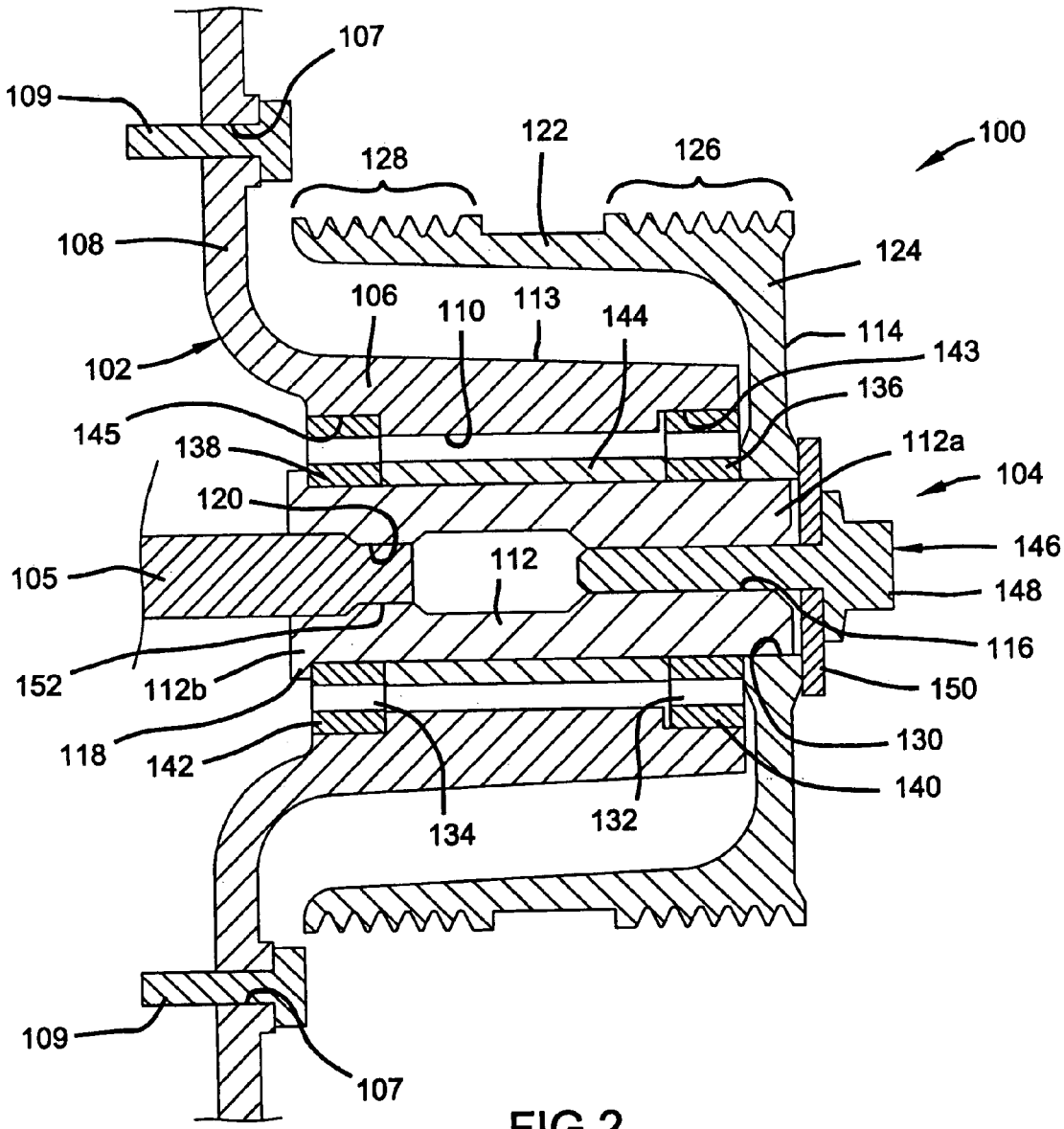
FIG. 2 is a side cross-sectional view of an exemplary embodiment of a double pulley assembly in accordance with the present invention.

FIG. 2 depicts the double sheave pulley assembly 100 generally including a housing 102 and an auxiliary drive component 104. The housing 102 is adapted to be substantially stationarily mounted to the vehicle engine 10. The auxiliary drive component 104 is rotatably supported by the housing 102. The auxiliary drive component 104 is drivingly coupled to an input shaft 105 of the power steering pump 24.

The housing 102 includes a body portion 106 and a flange portion 108. The body portion 106 includes a generally cylindrical interior surface 110 and a generally conical exterior surface 113. The flange portion 108 includes a plurality of recesses 107 that receive a plurality of fasteners 109 to mount the double sheave pulley assembly 100 to the engine 10.

The auxiliary drive component 104 includes a shaft 112 and a rotary member 114. The shaft 112 includes a first end 112*a* having a threaded internal bore 116 and a second end 112*b* having an external flange 118 and a plurality of internal teeth 120. The rotary member 114 includes a pulley portion 122 and a base portion 124. The pulley portion 122 is generally cylindrical in shape and includes a first plurality of annular grooves 126 defining the second pulley portion 100*b* and a second plurality of annular grooves 128 defining the first pulley portion 100*a*. The base portion 124 is a generally circular plate having an aperture 130. The aperture 130 receives the first end 112*a* of the shaft 112 to support the rotary member 114 thereon.

The shaft 112 supports the auxiliary drive component 104 for rotation relative to the housing 102. A first bearing 132 is positioned at the first end 112*a* of the shaft 112. A second bearing 134 is positioned at the second end 112*b* of the shaft 112. The first bearing 132 includes an inner race 136 and an outer race 140. The second bearing 134 includes an inner race 138 and an outer race 142. Outer race 140 is press-fit within a counter-bore 143 of the housing 102. Outer race 142 is press-fit within a counter-bore 145 of the housing 102. The inner races 136, 138 are slip-fit on the shaft 112. A shaft sleeve 144 is positioned on the shaft 112 between the first bearing 132 and the second bearing 134 to space apart the first 132 and second 134 bearings a predetermined distance.

A threaded fastener 146 threadably engages the threaded internal bore 116 of the shaft 112 to maintain axial engagement of the components of the assembly 100. A head 148 on the threaded fastener 146 engages a washer 150, which in turn engages the base portion 124 of the rotary member 114 on the auxiliary drive component 104. The base portion 124 engages the inner race 136 of the first bearing 132. The inner race 136 of the first bearing 132 engages the shaft sleeve 144. The shaft sleeve 144 engages the inner race 138 of the second bearing 134. Finally, the inner race 138 of the second bearing 134 engages the external flange 118 formed on the second end 112*b* of the shaft 112. Hence, the threaded fastener 146 clamps the rotary member 114, the first bearing 132, the shaft sleeve 144, and the second bearing 134 between the external flange 118 and the washer 150 to provide proper alignment and support for rotary member 114.

During operation, the plurality of internal teeth 120 on the second end 112*b* of the shaft 112 are splined to a plurality of external teeth 152 formed on the input shaft 105. A drive belt 34 (shown in FIG. 1), such as a serpentine belt, engages the second plurality of annular grooves 128 formed on the pulley portion 122 of the rotary member 114. An auxiliary belt 36 (shown in FIG. 1) engages the first plurality of annular grooves 126 formed on the pulley portion 122 of the rotary member 114. Due to belt wrap and belt tension, radial loads are often generated while one or both of the above-described belts deliver torque to the rotary member 114. Transmission of these radial loads to the input shaft 105 of the vehicle accessory can substantially decrease the useful life of the vehicle accessory. Therefore, the housing 102 reacts the radial loads experienced by the rotary member 114 to ensure that only torque is transmitted to the input shaft 105 of the vehicle accessory.

Figure 3:
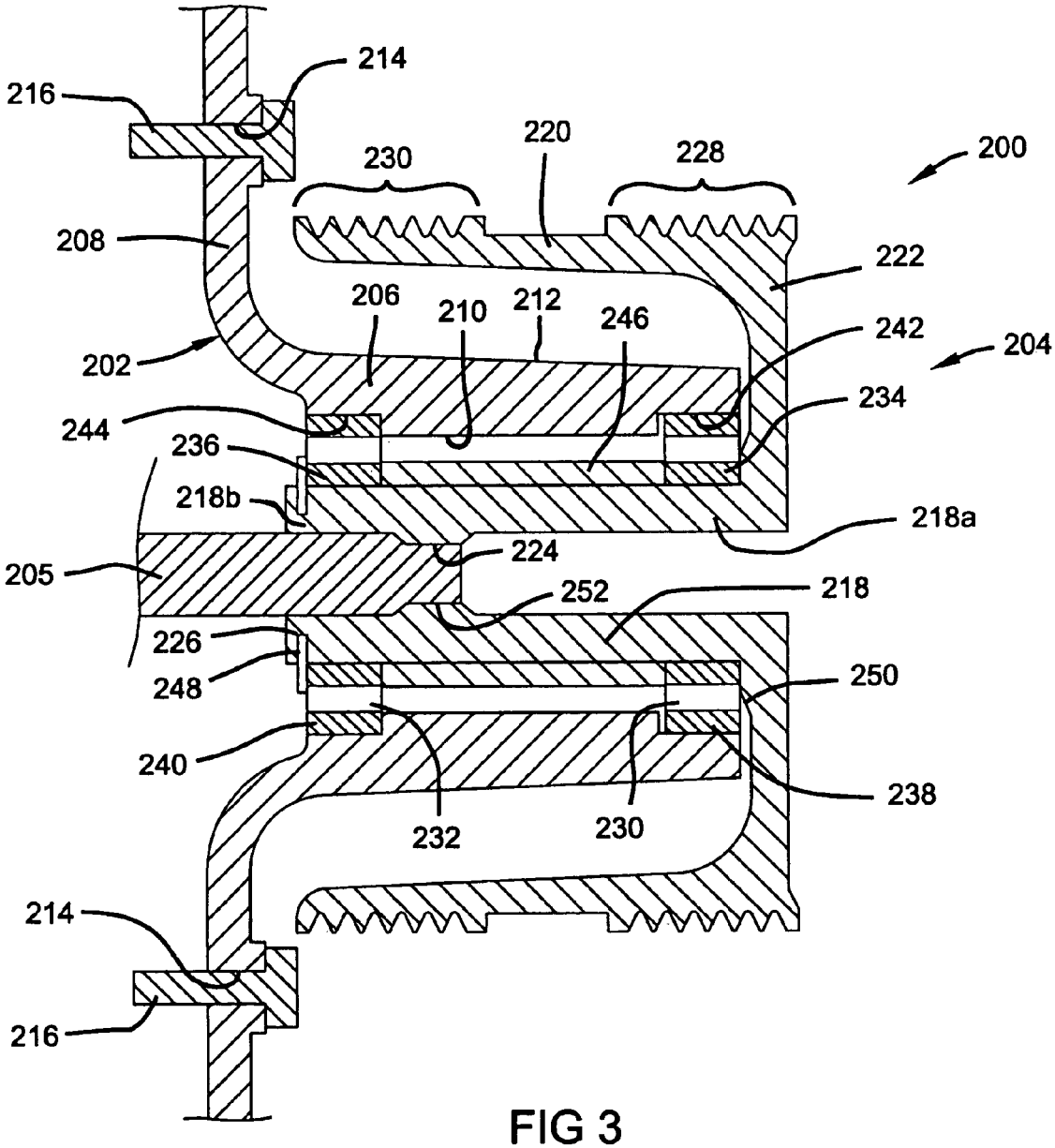
FIG. 3 is a side cross-sectional view of an alternative embodiment of a double pulley assembly in accordance with the present invention.

FIG. 3 depicts an alternative double sheave pulley assembly 200 generally including a housing 202 and an auxiliary drive component 204. The housing 202 is adapted to be substantially stationarily mounted to a vehicle engine 10 (shown in FIG. 1). The auxiliary drive component 204 is rotatably supported by the housing 202. The auxiliary drive component 204 is drivingly coupled to an input shaft 205 of the power steering pump 24.

The housing 202 includes a body portion 206 and a flange portion 208. The body portion 206 has a substantially cylindrical interior surface 210 and a substantially conical exterior surface 212. The flange portion 208 includes a plurality of recesses 214 that receive a plurality of fasteners 216 for being mounted to the engine 10.

The auxiliary drive component 204 is a one piece member including a shaft portion 218, a pulley portion 220, and a base portion 222. The shaft portion 218 is rotatably supported within the housing 202, thereby rotatably supporting the pulley portion 220 outside the housing 202. The shaft portion 218 includes an outer end 218*a* and an inner end 218*b*. The inner end 218*b* includes a plurality of internal teeth 224 and an annular channel 226. The pulley portion 220 includes a first plurality of annular grooves 228 and a second plurality of annular grooves 230. The base portion 222 is a substantially circular plate that provides the radial transition between the shaft portion 218 and the pulley portion 220.

A first bearing 231 is positioned at the outer end 218*a* of the shaft portion 218. A second bearing 232 is positioned at the inner end 218*b* of the shaft portion 218. The first bearing 231 includes an inner race 234 and an outer race 238. The second bearing 232 includes an inner race 236 and an outer race 240. Outer race 238 is press-fit within counter-bore 242 of the housing 202. Outer race 240 is press-fit within counter-bore 244 of the housing 202. The inner races 234, 236 are slip-fit on the shaft portion 218. A shaft sleeve 246 is positioned between the bearings 231, 232. A snap ring 248 engages the annular channel 226 formed in the inner end 218*b* of the shaft portion 218.

During assembly, the bearings 231, 232, shaft sleeve 246, and housing 202 are assembled before applying the snap ring 248. This aforementioned assembly is pre-loaded in the axial direction and then the snap ring 248 is applied to the annular channel 226. The snap ring 248, thus, provides a clamping force to the components of the assembly 200. The snap ring 248 engages the inner race 236 of the second bearing 232. The inner race 236 of the second bearing 232 engages the shaft sleeve 246. The shaft sleeve 246 engages the inner race 234 of the first bearing 231. The inner race 234 of the first bearing 231 engages a shoulder 250 formed on an inside surface of the base portion 222 of the auxiliary drive component 204.

Operation of this alternative embodiment of the double sheave pulley assembly 200 is similar to that of the first embodiment described above. The plurality of internal teeth 224 on the inner end 218*b* of the shaft portion 218 are engagingly splined to a plurality of external teeth 252 on the input shaft 205 of the vehicle accessory. A drive belt 34 (shown in FIG. 1) engages the second plurality of annular grooves 230 formed on the pulley portion 220 of the auxiliary drive component 204. An auxiliary belt 36 (shown in FIG. 1) engages the first plurality of annular grooves 228 formed on the pulley portion 220 of the auxiliary drive component 204. The component assembly just described assures that a bending moment is not imported onto the input shaft 205 of the vehicle accessory. As described above, with reference to the first embodiment, the housing 202 reacts the radial loads generated by one or both of the belts delivering torque to the pulley portion 220 of the auxiliary drive component 204.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A pulley assembly adapted to transmit torque from a drive pulley to first and second driven accessories, the pulley assembly comprising:

a housing;

an auxiliary drive component rotatably supported by said housing and adapted to be coupled to the first driven accessory, said auxiliary drive component including first and second annular drive surfaces, said first drive surface adapted to be drivingly coupled to the drive pulley, said second drive surface adapted to be drivingly coupled to the second driven accessory;

a bearing assembly coupled to said housing, said bearing assembly rotatably supporting said auxiliary drive component, wherein said bearing assembly includes a first bearing, a second bearing, and a sleeve axially positioned between said first and second bearings; and a fastening device providing an axial clamping load to said auxiliary drive component, said first bearing, said sleeve and said second bearing.

2. The pulley assembly of claim 1 wherein said fastening device includes a snap ring operable to maintain said axial clamping load.

3. The pulley assembly of claim 1 wherein said fastening device includes a shaft having a flange at one end and a fastener threadingly engaging an opposite end of said shaft, said fastener clamping said auxiliary drive component and said bearing assembly to said flange.

4. A double pulley assembly adapted to transmit torque from a drive pulley to a driven accessory, said pulley assembly comprising:

a housing;

an auxiliary drive component rotatably supported by said housing and adapted to be coupled to the driven accessory; and a fastening device in engagement with said auxiliary drive component to provide an axial clamping load on the assembly, said fastening device including a hollow shaft having a flange at one end and a fastener threadingly engaging a threaded bore formed in an opposite end of said shaft, said fastener applying a clamping force to said auxiliary drive component, a bearing assembly and said flange.

5. The pulley assembly of claim 4 wherein said bearing assembly includes a first bearing, a second bearing, and a sleeve axially positioned between said first and second bearings.

6. The pulley assembly of claim 5 wherein said flange includes a snap ring coupled to said auxiliary drive component, said snap ring maintaining a compressive load on said first bearing, said second bearing and said sleeve.

7. An engine for transmitting torque, the engine comprising:

an engine block;

a first accessory coupled to said engine block, said first accessory being drivingly coupled to a first pulley;

a second accessory coupled to said engine block, said second accessory being drivingly coupled to a second pulley;

a crankshaft pulley providing drive torque to said first and second accessories;

a first flexible member drivingly interconnecting said crankshaft pulley and said first pulley; and a second flexible member drivingly interconnecting said first pulley and said second pulley, wherein said second flexible member engages only pulleys rotatable about axes offset from an axis about which said crankshaft pulley rotates.

8. The engine of claim 7 further including a housing mounted to the engine, said housing rotatably supporting said first pulley.

9. The engine of claim 8 wherein said first pulley includes first and second annular drive surfaces, said first flexible member engaging said first drive surface and said second flexible member engaging said second drive surface.

10. The engine of claim 8 further including a bearing assembly coupled to said housing, said bearing assembly rotatably supporting said first pulley.

11. The engine of claim 10 wherein said bearing assembly includes a first bearing, a second bearing, and a sleeve axially positioned between said first and second bearings.

12. The engine of claim 10 further including a fastening device providing an axial clamping load to said first pulley and said bearing assembly.

13. The engine of claim 12 wherein said fastening device includes a snap ring coupled to said first pulley.

14. The engine of claim 12 wherein said fastening device includes a shaft having a flange at one end and a fastener threadingly engaging an opposite end of said shaft, said flange adapted to react said clamping load.

15. The pulley assembly of claim 1 wherein the auxiliary drive component is a one-piece member having a cylindrically-shaped shaft portion as well as said first and second drive surfaces, said shaft portion being rotatably supported and positioned with a cavity formed in said housing.

16. The pulley assembly of claim 4 wherein the auxiliary drive component is a one-piece member having a cylindrically-shaped shaft portion as well as first and second drive surfaces, said shaft portion being rotatably supported and positioned with a cavity formed in said housing.

* * * * *